US010631696B1

(12) United States Patent
Williamson

(10) Patent No.: US 10,631,696 B1
(45) Date of Patent: Apr. 28, 2020

(54) MULTI-CHAMBER VACUUM CLEANER DUSTING ATTACHMENT WITH INDEPENDENT ADJUSTABLE ACCORDION HOSE

(71) Applicant: Kathleen J. Williamson, East Stroudsburg, PA (US)

(72) Inventor: Kathleen J. Williamson, East Stroudsburg, PA (US)

( * ) Notice: Subject to any disclaimer, the term of this patent is extended or adjusted under 35 U.S.C. 154(b) by 22 days.

(21) Appl. No.: 15/451,192

(22) Filed: Mar. 6, 2017

Related U.S. Application Data

(60) Provisional application No. 62/303,864, filed on Mar. 4, 2016.

(51) Int. Cl.

| | |
|---|---|
| ***A47L 9/06*** | (2006.01) |
| ***A47L 9/24*** | (2006.01) |
| ***A47L 9/30*** | (2006.01) |
| ***A47L 9/32*** | (2006.01) |

(52) U.S. Cl.
CPC ..... *A47L 9/0693* (2013.01); *A47L 9/0673* (2013.01); *A47L 9/0686* (2013.01); *A47L 9/244* (2013.01); *A47L 9/30* (2013.01); *A47L 9/327* (2013.01)

(58) Field of Classification Search
CPC ..... A47L 9/0686; A47L 9/0693; A47L 9/24; A47L 9/242; A47L 9/248; A47L 9/30
USPC ..... 15/324, 396, 415.1–422.1
See application file for complete search history.

(56) References Cited

U.S. PATENT DOCUMENTS

| | | | | |
|---|---|---|---|---|
| 986,245 A | | 3/1911 | Thurman | |
| 2,198,339 A | | 4/1940 | Hamilton | |
| 2,271,694 A | * | 2/1942 | Johnson | A47L 4/02 15/394 |
| 2,584,515 A | | 2/1952 | Udell | |
| 2,606,338 A | | 8/1952 | De Lorenzo | |
| 2,800,678 A | * | 7/1957 | Wessel | A47L 9/06 15/367 |

(Continued)

FOREIGN PATENT DOCUMENTS

| | | | |
|---|---|---|---|
| DE | 102007006389 A1 | 10/2008 | |
| EP | 0180367 A3 | 5/1986 | |

(Continued)

*Primary Examiner* — David Redding
(74) *Attorney, Agent, or Firm* — Clinton H. Wilkinson

(57) ABSTRACT

A vacuum dusting attachment including a semi-flexible, elongated, thin, flat cleaning portion for tight spaces having multiple dust collecting chambers and aperture openings for equalizing and maximizing vacuum suction, light elements for improving visual efficiency, side edge brushes for loosening dust and increased dust capture, and a detachable, microfiber mesh cover for the cleaning portion for dust capture and retention; and a connected swivel handle portion including an ergonomically designed cushioned hand portion with soft raised ridges and bumps for non-slippage. An additional independent accordion hose extension vacuum attachment for use with aforesaid dusting attachment or other devices is provided, manufactured to withstand vacuum suction so as to retain desired lengths and bends to reach distant target areas, increasing flexibility when handling an attached dusting attachment, while collapsing for less space, and including a grip disk at one end, and an ergonomic handle on an opposite end, both for handling while in the act of extending, collapsing, and bending.

20 Claims, 8 Drawing Sheets

(56) References Cited

U.S. PATENT DOCUMENTS

| | | | | |
|---|---|---|---|---|
| 2,811,738 | A | 11/1957 | Gall | |
| 3,147,509 | A | 9/1964 | Sieb | |
| 4,053,962 | A | 10/1977 | McDowell | |
| 4,161,802 | A | 7/1979 | Knight et al. | |
| 4,459,720 | A | 7/1984 | Ahlf et al. | |
| 4,553,284 | A | 11/1985 | Strumbos | |
| 4,694,529 | A | 9/1987 | Choiniere | |
| 4,997,209 | A | 3/1991 | McGrath et al. | |
| 5,050,266 | A | 9/1991 | Schneider | |
| 5,060,341 | A | 10/1991 | Nelle | |
| 5,123,142 | A | 6/1992 | Miller | |
| 5,502,870 | A | 4/1996 | Ragner et al. | |
| 5,533,230 | A | 7/1996 | Rouda | |
| D405,570 | S | 2/1999 | Broecking | |
| 5,896,618 | A * | 4/1999 | Woo | F21V 33/0044 15/324 |
| 6,026,541 | A | 2/2000 | Bailey et al. | |
| 6,044,521 | A | 4/2000 | Sebek | |
| 6,370,731 | B1 | 4/2002 | Carter | |
| D491,326 | S | 6/2004 | Schroter | |
| 6,802,104 | B1 | 10/2004 | Redd | |
| D513,101 | S | 12/2005 | Allard et al. | |
| 7,784,137 | B2 | 8/2010 | Knopow | |
| 7,784,149 | B2 * | 8/2010 | Schwarz | A47L 5/24 15/209.1 |
| D733,376 | S | 6/2015 | Bennett et al. | |
| 2007/0209154 | A1 | 9/2007 | Griffith et al. | |
| 2008/0086834 | A1 | 4/2008 | Schwarz et al. | |
| 2009/0172912 | A1 | 7/2009 | Knopow | |
| 2010/0170060 | A1 | 7/2010 | Eccardt et al. | |
| 2010/0306954 | A1 | 12/2010 | Coscarella | |
| 2015/0223656 | A1 | 8/2015 | Tucker et al. | |

FOREIGN PATENT DOCUMENTS

| | | | |
|---|---|---|---|
| EP | 0377801 | A1 | 7/1990 |
| EP | 0931498 | A1 | 7/1999 |
| ES | 2199000 | A1 | 2/2004 |
| FR | 2739275 | A1 | 4/1997 |
| GB | 2276311 | A | 9/1994 |
| JP | 09327423 | A | 12/1997 |
| WO | 2002000086 | A2 | 1/2002 |
| WO | 2008048552 | A2 | 4/2008 |

* cited by examiner

FIG. 2A
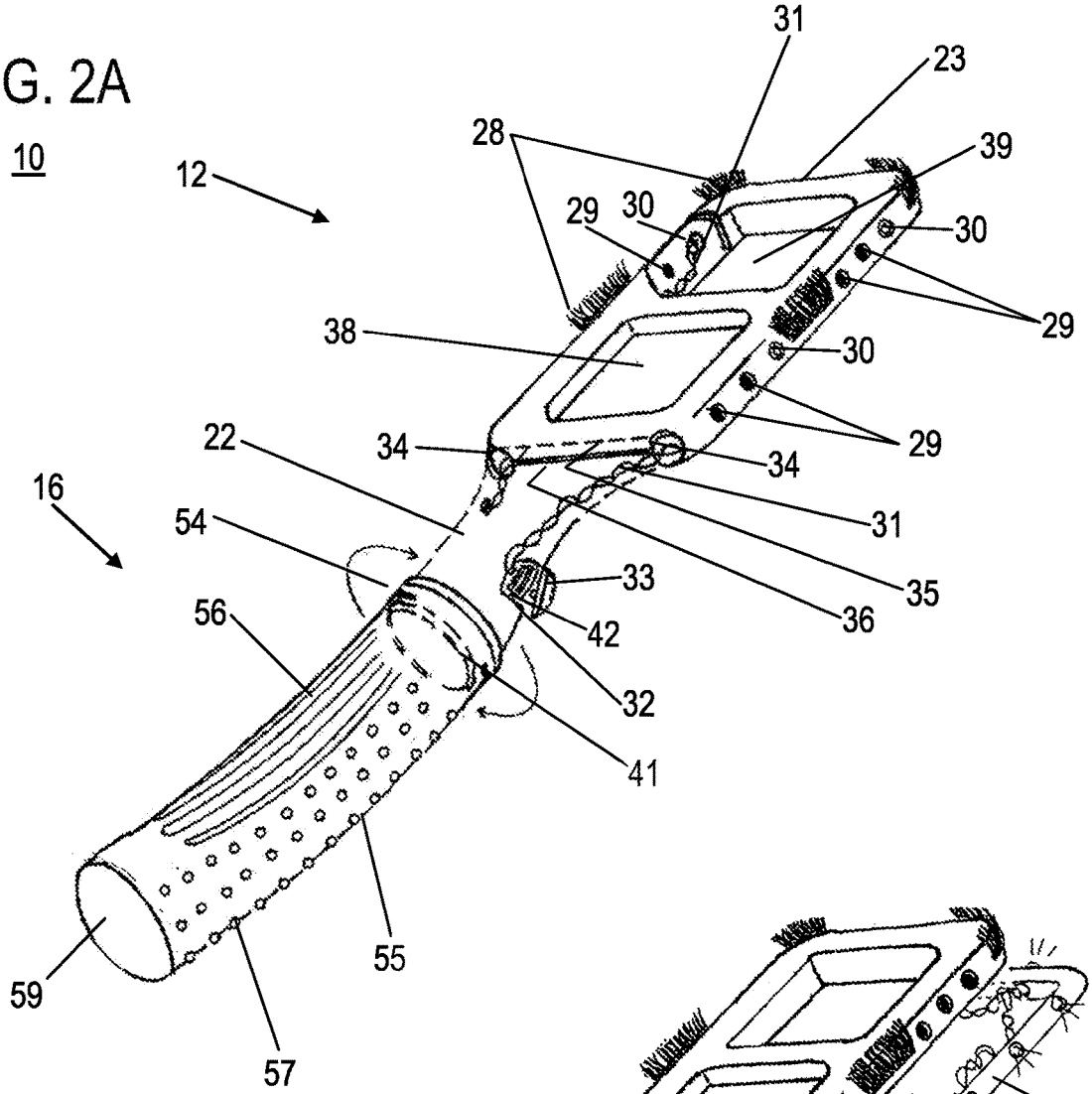
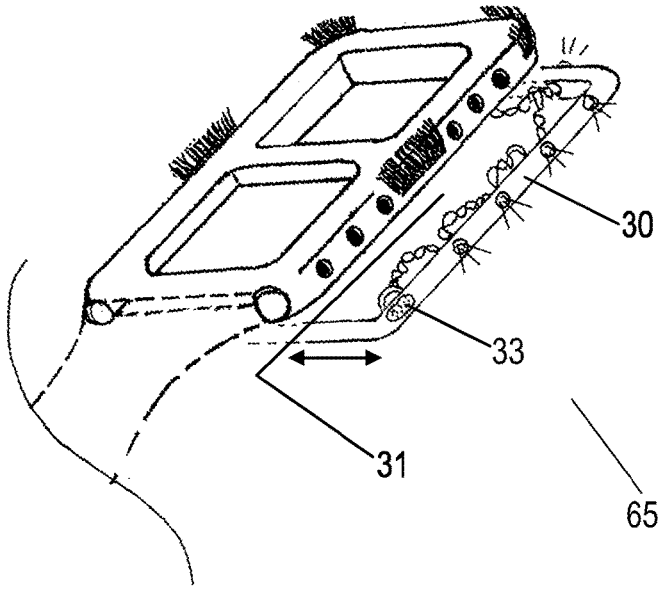
FIG. 2B

MULTI-CHAMBER VACUUM CLEANER DUSTING ATTACHMENT WITH INDEPENDENT ADJUSTABLE ACCORDION HOSE

FIELD OF THE INVENTION

The present invention relates to attachments and accessory tools for surface cleaning appliances such as vacuum cleaners, and more particularly to a thin, flat, semi-flexible, elongated multi-chambered dusting attachment having an ergonomically superior swivel handle, affixed edge lights and brushes, and a detachable microfiber mesh cover, as well as an independent adjustable accordion hose attachment with a grip end.

BACKGROUND OF THE INVENTION

Surface cleaning appliances such as vacuum cleaners for cleaning floors, upholstery, and other surfaces in a home or workplace are generally known in the prior art. The most popular household vacuum cleaners are either upright standing or canister style vacuum cleaners, although other more specialized types such as handheld vacuums, central air vacuum systems, electric brooms, and shop vacuums are also available. Household vacuum cleaners typically include a primary electrically motorized surface cleaning component which includes a spinning rod having a series of affixed stiff bristles segregated in individual circumferential rows, forming a rolling brush for cleaning floor areas such as rugs or hard floor surfaces by passing the surface cleaning component across the surface to be cleaned in a generally back and forth motion, whereby dirt and debris is collected into a bag or receptacle by a suction force provided by a vacuum unit. Canister style vacuums allow for the handle to detach from the surface cleaning component where it then can be attached to other cleaning attachments. The canister handle is normally connected to a flexible extension hose, which hose is connected to the vacuum unit. Most upright vacuum cleaners are equipped with a separate flexible extension hose that is connected independent of the surface cleaning component. Both the canister style vacuum handle and the upright vacuum flexible hose terminate with a rigid coupler hose used for connecting various vacuum attachments such as rigid extension hoses and other purposed cleaning attachments used to clean those areas that cannot be cleaned using the primary flooring roller brush component.

There are many vacuum device attachments on the market today and vary in shapes and sizes to accommodate various cleaning projects, for instance, a crevice tool can in one example be used to clean between cushions and in another instance a stiff bristled tool is used to vacuum debris from the cushion's top surface. The present invention, however, is primarily concerned with those attachments that are used for dusting smooth, hard surfaces. Also available are rigid extension hoses which are connected between the vacuum's original flexible hose and an attachment to reach further areas out of reach. A problem that occurs upon the purchase of a vacuum machine is that the assortment of attachments provided do not cover all the cleaning needs of a home or workplace, especially for the purpose of dusting in a comfortable and thoroughly complete manner as well as being lightweight. To fill the various cleaning needs, consumers therefore must purchase additional vacuum attachments that are more applicable to their specific cleaning chores. Such additional purposed vacuum attachments are either purchased from the manufacturer of purchased vacuum machine, or similar or better designed vacuum attachment is purchased from a different manufacturer.

When either close-up or distant dust cleaning is required, known vacuum attachments on the market do not adequately meet the basic dusting needs of the consumer. This is particularly true with respect to close up dusting, where consumers usually resort to old fashioned dusting methods either by hand or by the use of a feather duster and/or a rag, since the available vacuum dusting attachments are too bulky or odd-shaped to fit in particular spaces, and/or it is inordinately difficult to a direct the dust collecting aperture opening towards the area to be vacuumed. Other reasons include that most available attachments on the market today are rigid throughout the whole of the attachment, or a flexible area, if included, is usually in one location only. An example of this would be an attachment that is configured to reach under furniture, where the attachment bends only at one point and allows the attachment to flatten out so the user doesn't have to lay on the floor to guide the direction of the attachment. Most vacuum attachments once affixed onto a rigid extension hose are usually fixed in a set or limited radii positions, and thus are not sufficiently flexible to reach specific target nooks and crannies with the delicacy required for dusting items such as inside shelf corners, statuettes, under stereo equipment, Venetian blinds large and mini, and such. Some attachments are so unwieldy as to be of any use, usually requiring the consumer to expend too much effort of using their hand, wrist, or body maneuvering while endeavoring to accomplish the same chore that ends up being easier to accomplish with a rag or feather duster. Much time is also expended in changing various different attachments seeking the desired cleaning effect. Since use of a feather duster and/or a rag to dust usually just re-spreads the dust back into the household air, the dusting chore is short lived as this newly disturbed air-borne dust just resettles upon other surfaces. Sometimes a consumer may try to use both a vacuum and a feather duster or similar dusting apparatus by leaning the open vacuum hose near the area to be dusted hoping that the newly released air-borne dust is captured and transferred into the vacuum receptacle. The consumer is already significantly burdened by having to carry around specific purposed cleaning attachments, rigid extension hoses for distant out of reach areas, and then is further burdened by also carrying around additional feather dusters, rags, and such, with their accompanying cans/bottles of spray and liquid cleaners.

Vacuum attachments available on the market today for the purpose of dusting therefore have limited properties in catching dust nodes. For obvious reasons, there can only be so many open apertures on an attachment since there must be some solid walls to contain and provide the vacuum suction and the larger the aperture, the more dissipated the vacuum suction becomes. As a result, the majority of dusting vacuum devices have small apertures, which require extra sweeping back and forth to collect dust. Another problem with vacuum dusting attachments on the market today is that each attachment is shaped for specific dusting purposes. For example, the consumer will carry around, while cleaning, a bent shaped attachment to reach and dust the upper blades of a ceiling fan, and additionally will usually need to carry an accompanying rigid extension hose that has been purposely bent to facilitate the angle of the attachment, so that the open aperture faces the upper ceiling fan blade correctly. When the consumer is finished, they have to change out the dusting attachment and/or rigid extension hoses to dust another type of surface, the point being is when it comes to dusting, the consumer can see the futility of using the vacuum machine for dusting as it becomes a time-consuming chore of dusting. The consumer is faced with repeated movements by making sure the aperture opening is placed in the correct position for collecting dust, making extra sweeping movements due to the limited size of the aperture(s), and the necessary repeated interchanging of attachments in the process of matching the dusting attachment to each particular dusting chore. Consumers end up carrying arm loads of various purposed attachments, and wasting time in reconfiguring of the placement of attachments in relation to each device's configuration. They also must endure sometimes excruciating maneuvering of their body to direct the attachment's aperture opening to where dusting is needed, including the unsafe use of ladders, chairs, the top of wobbly couch cushions, and such. Furthermore, when distant areas need to be cleaned, the consumer adds any number of rigid extension hoses which make vacuuming even more dangerous as the added weight of the extensions make it harder for the consumer balance, and also adds the possibility that the longer the rigid extension hoses are the more uncontrollable they become, whereby the unwieldy length causes the attachment and/or hose to inadvertently knock over, for example, lamps, or damage unintended objects such as walls that they come into contact with. When extra rigid extension hoses are used, the attachment placed at the farthest end again is in its rigid position and once there, the whole assembly must be moved back down towards the consumer so the attachment's aperture opening can be manually repositioned into another desired direction.

The consumer encounters further problems with vacuum attachments especially with respect to where they should grasp the wand and/or the attachment when connected together. Any time an attachment is affixed to a corresponding hose, the hand is forced to endure the uneven crack formed between the two attachments so as to use the wrist to guide the attachment in the desired direction since a comfortable handle to grasp is not included on most attachments, or to the knowledge of this inventor, none that can be found. The consumer therefore resorts to holding the rigid wand, or the uneven connected site area, especially when using the flexible hose and rigid coupler hose extending out of the upright vacuum cleaner. Even though the flexible hose of a canister vacuum ends in a handle before an attachment is affixed to the rigid coupler hose, consumers who use the canister's vacuum's handle will find that the grip is usually oversized, awkward, and on the heavy size, due to the handle's original intent of use for directing the path of the main motorized primary surface cleaning component, and not necessarily designed to enhance nor being convenient to use with individual affixed attachments. Therefore, either using an upright or canister style vacuum cleaner, the consumer encounters physical discomfort while trying to dust. Many modern consumer devices, from kitchen utensils and so on, have a handle which is made to fit comfortably in the user's hand, and in addition most of the handles in these other markets are made of a soft thermal plastic rubber (TPR) material or a combination of hard and soft/padded material. Such comfort handles are beneficial to all users and particularly to the many individuals that suffer from carpel tunnel syndrome, osteoarthritis, and other painful maladies of the hand, wrist, arms, and back. In addition to a softer and a more comfortable grip handle, devices offered in other markets are also sometimes manufactured with grip-like protrusions so the user has in their possession a slip resistant article, which is invaluable when a cleaning chore produces sweat on the individual's hands. There is therefore a need for a vacuum attachment tool that can be used to easily and effectively pick up dust and debris which has an ergonomic and comfortable handle which makes holding and manipulating the device easier in a more effective manner, while also being able to swivel in a specific direction when needed.

Another problem with known vacuum dusting attachments is that for the most part there is nonexistent or inadequate lighting incorporated in the individual attachments themselves, which would facilitate seeing the dusting area to be cleaned, especially areas that are in shadow such as behind other items on a shelf, or the lighting due to the time of day. Usually only the motorized primary surface cleaning component is complemented with lighting to light up the area in front of it to be vacuumed, but it would be especially an advantage to have peripherally overall lighting on an attachment to be able to see all surrounding areas that are being vacuumed, thus speeding up and improving the cleaning process. The advantages of providing lighting on an attachment itself are twofold, in that the area to be dusted is lit up, and the emitted lighted beams allow the consumer to actually see and confirm that the dust nodes/particles are being collected into the vacuum attachment. Unfortunately, due to the lack of sufficient lighting on vacuum attachments, a consumer might devise to precariously place a lamp closer to an area, or employ the uncoordinated use of a flashlight to obtain the same results.

As aforementioned, rigid extension hoses quickly become unwieldy and heavy to maneuver while using an attachment at their farthest end. Additionally, rigid extension hoses are of a determined length. When a consumer needs an attachment to reach a distant area to be cleaned, a single rigid extension hose might be too short which might necessitate the consumer to stand dangerously on ladders or furniture. When additional rigid extension hoses are added to reach the target area, the hose length might be too long, causing the consumer to then move furniture out of the way so as to be able to move backwards. If unmindful while focusing on the distant vacuum attachment while cleaning, there is the possibility of the consumer tripping and falling backwards over furniture, or even falling backwards down stairs. Besides trying to match the distance required, the consumer will become frustrated further trying other various ways of focusing the rigid vacuum attachment's aperture opening to the target area using the inflexible and unbendable rigid extension hose.

BRIEF SUMMARY OF THE INVENTION

Accordingly, it is the intention of the inventor to provide an improved light-weight vacuum dusting attachment that is flexible, has an increased vacuum suction, an ergonomic handle, and includes a flexible lightweight independent accordion hose vacuum attachment. In the preferred mode, the vacuum dusting attachment device includes two sections, namely, a cleaning portion and a handle portion, in which at the location where such portions connect allows for the device to swivel, while in other modes the device could be made of several parts or of a singular part. The accordion hose would replace conventional rigid extension hoses and includes a handle on one end so as to allow the consumer to grasp at any comfortable interval while cleaning at long distances, and a disk on the other end, both for holding, extending, collapsing, and bending the hose to desired shape and length to reach the cleaning target area while supporting the weight of aforesaid attachment or other attachments. Alternatively, the cleaning portion and handle portion could be manufactured in separate pieces, and the accordion hose could have two disk grip ends, and then with the creation of an additional part of a shorter handle coupler to be used between the individual components, which would allow an even greater number of various alternative configurations. Although separating the cleaning portion from the handle portion of the vacuum dusting attachment would most likely limit or forfeit the swiveling action of the attachment device, other advantages by the consumer may be realized especially when long distance dusting is required, such as improved directional ability of the device and a lighter overall unit. The handle portion of the device is a unique and a much-improved asset in the vacuum attachment market particularly when the consumer is dusting up close. When the consumer is employed in long distance dusting chores such as reaching Venetian blinds that are located above and beyond unmovable furniture, and inaccessible by normal methods, there is no need for the handle to be attached to the cleaning portion. By replacing the handle end on the accordion hose with another disk grip, and coupling multiple accordion hoses together with a short handle coupler, this would further lighten weight while still enabling the consumer to comfortably extend and collapse the hose. Marketability of either approach in the manufacturing process would be evaluated and most likely determined be pricing and market demand. This alternative approach is discussed further and illustrated in the last drawing figure.

In accordance with an embodiment of the present invention featured in the accompanying drawings, the vacuum dusting device is made up of two sections: a flat cleaning portion in which one flat side has two large open apertures that are separated by a horizontal panel and configured to equalize the vacuum suction in the apertures, a solid flat side to contain the vacuum suction, and a tubular perimeter side extending along the three outside edges of the flat cleaning portion and including several small aperture openings, light elements, and clusters of brushes; the two long side edges of the vacuum dusting device round out and narrow so as to become a neck-like handle, or part of a handle; and a handle portion which becomes coupled with a portion connected to the vacuum cleaner. The flat cleaning portion and handle portion may be manufactured as one piece without swiveling, but in a preferred embodiment they would be separate pieces, so that where the two pieces connect, the handle portion and the flat cleaning portion are allowed the ability to swivel providing a greater range of movement in the cleaning process. One possible method to allow swiveling, but not limited to, is to construct an outer ridge on the narrow rounded end of the flat cleaning portion, and an internal protruding ridge inside the handle portion that will face the flat cleaning portion, whereby the outside ridge of the flat cleaning portion would lean up against the internal protruding ridge inside the handle portion which would allow the two portions to swivel at this connected area, as well as to retain the flat cleaning portion within the handle portion. But there are several ways to manufacture and attach the two portions which would accomplish the same swiveling effect in accordance with the invention, if this is the desired end result of manufacturing a two piece tool as opposed to a one piece non-swiveling manufactured tool. A small opening and closing sliding vent (not shown) could also be provided in the neck area or the handle area to further control the amount of suction to the open apertures of the vacuum dusting attachment.

The flat cleaning portion of the vacuum dusting attachment device may be manufactured as one piece, preferably by injection molding using a material such as, but not limited to thermal plastic rubber (TPR) or a silicone material to allow for flexibility. One side of the flat cleaning portion would be enclosed while the other side would present, but not limited to, two large open apertures for collecting dust. A horizontal panel with a raised lip in the center of the flat area would separate the two open apertures which would separate the vacuum suction allowing for the equalization of suction. Provision of separate vacuum suction apertures in the flat cleaning portion allows the apertures to be larger than in most available dusting attachments on the market. To further increase the dust collecting capacity of the flat cleaning portion, a plurality of small open apertures would be placed along the outside perimeter of the flat cleaning portion. In one embodiment, open hole apertures would be cut along the side walls of each flat horizontal chamber, while in another embodiment a separate perimeter tube would be positioned surrounding the three outside edges of the flat cleaning portion, where this tube would be a separate vacuum chamber apart from the two flat horizontal vacuum chambers. On the outer portion of the perimeter tube, aperture holes, lights, and segmented clusters of brushes would be presented. In this preferred embodiment, vacuum suction potential is maximized using two planes of the flat cleaning portion—one flat side, and three rounded side walls, out of three possible exposed surfaces of the flat cleaning portion of the vacuum dusting attachment device. In another embodiment, the vacuum dusting cleaning portion could be manufactured without the hollow chamber perimeter, with the lights and brushes attached. In embodiments where an independent separate outside perimeter is provided in which lights and string wiring is inserted, it may require that this outside perimeter tube be attached separately to the perimeter of the flat cleaning portion during the manufacturing process, in which case one alternative would be to manufacture the outside perimeter tube to slide on and off the flat cleaning portion, so as to be able to replace or repair the wiring for the lights. Whether the product in the several embodiments has a plurality of parts, or is simplified into one part, it still will function in the same manner in accordance with the present invention. An objective of the present invention therefore is to manufacture a vacuum dusting attachment device that is lightweight, with maximum open apertures, lighting, and brushes for dust collection, made of material that will provide a soft, rounded corner device, with semi-flexible bending properties, yet not so flexible as to allow for the air flow openings of the apertures to collapse while bending which would cut off the vacuum suction, which might necessitate adding a supportive material within in various locations.

The flat cleaning portion is designed to fit into tight spaces such as between Venetian blinds or under entertainment units, and a plurality of chambers are incorporated to provide maximum vacuum suction throughout all the open apertures, giving the device an overall larger open aperture than available on the market today. Accordingly, the top two open apertures are split horizontally, while the outer side edge open apertures are located on the outside of a tubular chamber vent that surrounds the three outside edges of the flat cleaning portion, or apertures along the walls of the two horizontal flat chambers.

Now referring to the aforementioned top two open apertures, both apertures are configured to have equalized suction force owing to an added horizontal panel that is placed approximately halfway through the height of the flat cleaning section, starting internally at the open neck, and ending approximately halfway out the length of the flat cleaning portion, then turning upwards, creating two individual apertures. This horizontal panel creates two separate air flow chambers, equalizing the vacuum suction between the two created apertures. The upper open aperture chamber is formed by the splitting horizontal panel, which curves upwards at the midway point of the open top side of the dusting device and the surrounding side edges, while the lower open aperture chamber is formed by the base or bottom of the device and the surrounding side edges.

Now referring again to the flat cleaning portion of the device, an internal tubular vent along the sides of the perimeter of the three side edges of the flat cleaning portion of the device creates yet another separate chamber that has internal open ends on both sides of the flat portion of the device that face the neck portion. The tubular tunnel is solid facing the flat portion, but has hole apertures, lights, and brushes that are located on the outside. The perimeter tube could be permanently affixed or made to slide on and off of the flat portion so as to fix, replace wiring and bulbs, and to clean out stuck debris.

Accordingly, located on the perimeter outside edges of the flat cleaning portion in an embodiment are lights which are configured to enhance the user's visual efficiency in dusting. The light power source could be solar power, LED or other lighting options, where the lights are affixed to the outside edges and a charging pin port could be incorporated on the vacuum dusting device whereby the lights/battery/s are charged on a specially designed vacuum unit itself which would have the complimentary charging ports (powering the attachments while the machine is running, alternately charging different attachments while another attachment is being used, and/or charging while the vacuum is idle but plugged into a power source such as (but not limited to) an electrical outlet; and/or the vacuum attachments can be charged by a specially designed charging wall-type unit port that is plugged into a power source while the attachments are idle during storage; and/or a coefficient conductive material is incorporated throughout the hose and attachments where the vacuum dusting device gets constant power from the vacuum machine while said vacuum is running, but for presentation purposes button battery powered lights are discussed. Preferably the lights would be placed along the outside edges of the flat cleaning portion of the device, alongside of the aperture holes of the perimeter tube, but not covered by the mesh sock-like slip-on cover. The placement of the lights can be varied as long as surfaced to be cleaned are sufficiently illuminated during the dusting process. Through the provision of lights on the flat cleaning portion, consumers can actually see dust particles in the path of the emitted light beams being sucked up into the open apertures. Light elements are affixed to an internal wiring system and protrude out of the selected outer openings, forming a string of lights. The wiring system is affixed at one open end of the internal tubular vent chamber within the hollow neck area and weaves along inside the tubular vent to the other opening end of the tubular vent chamber in the neck area where the wiring ends and connects to an internal battery chamber. It may be necessary to affix the string of lights to one internal wall of the perimeter tube to maximize the vacuum suction potential. In the preferred embodiment, the battery chamber would contain small button batteries in order to limit the space used in the rounded or neck area of the flat cleaning portion of the device for maximum vacuum suction. The lid of the battery chamber resides externally and consists of, but is not limited to, a soft on and off button.

Also affixed to the outer side edges of the flat cleaning portion are separate segments or clusters of brushes for additional loosening and collection of dust. Semi-soft paint brush-like bristles are directed upwards towards and end slightly above the two upper open apertures to capture and direct dust towards the open apertures. Bristles that are soft allow delicate items to be cleaned without damage, as well as to pull dust out of hard-to-reach areas that the device does not reach such as, for example, strings that hold the slates in position on Venetian blinds.

The hollow handle portion of the vacuum dusting device is designed as a conduit for vacuum suction but the outer surface is also shaped ergonomically for the consumer's hand to hold the device in comfort. As with other vacuum attachments, the open nozzle end would frictionally attach to the accordion hose vacuum attachment or other type hoses, but could also employ a thread screw coupling attachment method. The preferable handle would incorporate an inner coupler area which would shorten and lighten the weight of the handle itself and this would also apply to the handle on the accordion hose vacuum attachment. The sizes and shapes of the coupling ends of both the vacuum dusting attachment and the accordion hose vacuum attachment would ideally be manufactured as closely as possible (but not limited to, and/or kept within the same manufacturer product line), to be able to couple with the current vacuums on the market today, although due to variances in manufacturing specification of different manufacturers a coupler adapter might be needed. Another alternative is to provide a newly devised vacuum machine created specifically for the vacuum dusting device and accordion hose, and quite likely other new additional purposed dusting devices, which would determine the shape and sizes of the device and hose so as to compliment the velocity of vacuum suction power of the newly devised vacuum machine. If the aforesaid specialty vacuum was devised, a system whereby pin ports could be placed on the attachments where they correspond to ports on the exterior of said vacuum machine so as to charge the lights while the attachment is not being used may also be provided.

The portion of the handle which the hand grips is ergonomically shaped for comfort and is coated in a soft material, while the interior is comprised of a more substantial or rigid material which would retain the handle shape and support the end nozzle for friction coupling with the accordion hose or other hoses/attachments. Protruding upwards around the handle area are numerous bumps and ridges which provide a better grip especially when the hand becomes sweaty. These bumps and ridges would be created in the manufacturing process of the soft outside coating of the handle.

The microfiber mesh cover which slips on and off of the flat cleaning portion of the vacuum dusting device is an integral part of the vacuum dusting attachment and is to be used to cover all the open apertures to filter dust particles and retain for later cleaning the debris that is too large for the mesh holes, yet held onto the microfiber fibers. In the preferred embodiment, the microfiber mesh cover is manufactured in a sock-like fashion, allowing for openings for the lights and brushes while covering the open apertures on the flat top and side perimeter. The mesh cover is retained on the device by an elasticized cloth enclosure (or other such type enclosure method) which grips the neck area behind the flat cleaning portion, yet is sock-like in that it is easy to pull off and on. In the preferred embodiment, the mesh is on both sides of the cover so the microfiber mesh sock can be pulled off and turned over to use the other side when one side is soiled. Another possible and favorable manufacture of the microfiber mesh cover is for the cover to be manufactured as a flat piece whereby Velcro® strips are sewn on the edges so the mesh cover can be wrapped around the vacuum dusting device and secured. Another alternative is to manufacture the microfiber mesh cover with the brushes and/or microfiber noodles sewn to the cover, instead of on the cleaning portion of the vacuum dusting attachment. The mesh can be vacuumed if the mesh becomes clogged with debris by removing the attachment device while still encased with the mesh cover and placing in front of an open vacuum nozzle for a quick cleaning of the mesh. This mesh cover would be washable to the manufacturer's directions and replaceable. Many alternative microfiber mesh covers could be designed for different uses, as well as color coded for individual areas that need dusting, or a disposable cover could be devised. The microfiber cover is in fact a necessary part of the vacuum dusting attachment as the vents are designed to intake only dust particles so as not to clog the vents. In the preferred embodiment, the mesh would be created with only microfiber threads, as microfiber is well known to pick up and retain dust and other debris. In another embodiment, the mesh cover could feature the mesh on the flat open aperture side and perimeter sides only, while the solid bottom of the flat portion would be covered with a solid piece of microfiber cloth which would aid in buffing the item dusted. In another alternative embodiment, the microfiber mesh cover could also be devised where it continued beyond the snug neck enclosure up, around, and over the handle area to form a cover or glove type enclosure where the consumer could place their fingers or hand within the enclosure so as to relieve pressure on the upper hand area from continuous use of the device while employed in monotonous cleaning chores such as for example dusting many Venetian blind slats on several windows at one cleaning session.

The accordion hose device would replace and/or be used in conjunction with the rigid extension hoses currently used when trying to reach distant target areas and would ideally be made with, but not limited to, a plastic which would be sturdy enough so as not to collapse from the vacuum suction, yet flexible to bend in a desired direction with ease and easy to extend and collapse. The material chosen for the accordion hose device would ideally withstand repeated usage without cracking. The hose provides a lighter and easier accessory to use than a rigid extension hose and has its own handle to use while directing the vacuum dusting device towards the target area. With the ability to expand and collapse to any distance desired within the realm of being completely collapsed and full extension within its manufactured limitations, the accordion hose device makes reaching target areas to be cleaned more manageable and flexible, especially with its ability to be bent by the consumer in any direction desired. Because the bellows of the accordion hose will be manufactured specifically to a thickness which will not collapse from the vacuum suction, in a preferred embodiment the total expanded length should be manageable of a full extension of a standard consumer's width of the arms, approximately two feet. If added length is required, one or more additional accordion hose devices could be attached, or as many as the consumer needs. The disk grip and the handle of the accordion hose vacuum attachment (which is the same handle used on the vacuum dusting device) are placed at the ends of the accordion portion specifically for making it easier for the consumer to pull out and expand the accordion hose, for pushing in to collapse the accordion hose, and bending the accordion hose. Another designed accordion hose could have the disk grips on both ends, to be used when a handle end is not needed for extended lengths. The other advantage is that the accordion hose portion collapses approximately a third of its fully extended length which makes it beneficial for storage and for carrying the accordion hose device around.

The grip disk of the accordion hose vacuum attachment is located behind the friction nozzle end that is inserted into another vacuum device and before the accordion hose begins and is made of a sturdy material which is coated with, but not limited to, a soft material such as TPR with the raised bumps and/or ridges similar to the handle on the vacuum dusting device's handle so as to provide a comfortable and ergonomic grasping handle for the consumer. This coating preferably covers both sides of the disk and extends towards the accordion hose as the circumference of the grip disk decreases down to match the width of the accordion hose.

The accordion hose device is attached between a vacuum dusting attachment device and the vacuum cleaner suction port and/or hose of the vacuum cleaner as in an upright vacuum cleaner. When the consumer prefers to hold the handle of the vacuum dusting attachment device for close vacuum cleaning chores, leaving the accordion hose device or devices attached allows the consumer freedom of movement and expansion of distance as well as flexibility of movement as opposed to a rigid extension hose to increase the reaching distance between the area to be cleaned and the vacuum cleaner. Although this also can be achieved by using the upright vacuum cleaner flexible hose, adding the accordion hose to the upright vacuum cleaner flexible hose significantly increases the distance and maneuverability. When using the accordion hose device with a canister vacuum, a consumer can increase their comfort by attaching the accordion hose device to the rigid handle, then dropping the canister handle and taking up the vacuum dusting attachment handle for improved flexibility, comfort, and added distance while using the vacuum dusting attachment for close-up cleaning.

The accordion hose assembly and the dusting attachment could also be constructed in an embodiment such that along or part of the outer, or interior, or within their walls and handles, a coefficient conductive material may be incorporated whereby the semiconductor material would transmit electrical power from the purposively designed vacuum cleaning unit and its engine in and through the hose/s to the attachment/s for powering said attachment/s' lights or other amenities.

It is planned that the vacuum dusting attachment device and the accordion hose attachment device (and/or specially created vacuum cleaning unit) would be sold together and be accompanied with a convenient carryall bag, or other receptacle, or cart, to carry the devices over the consumer's shoulder, or around the waist, upon the back, or by wheeling around, while cleaning. It should also be noted that the vacuum dusting device and the accordion hose device of the present invention would be compatible for use with, but not limited to, other vacuum attachments, although on some vacuum models a coupler adaptor might be needed since different manufacturers in the vacuum industry are not consistent in their measurements.

The overwhelming intention of devising the present invention is to provide a lightweight and comfortable vacuum dusting attachment device and hose that is easy to use by the consumer. Although a handle is unique for vacuum attachments and an advantage especially for close up cleaning, the invention may also be advantageously manufactured in several parts so to be more practical for use when long distance cleaning is required, allowing a straight directional line to the area being cleaned while also minimizing total weight of the unit. In this scenario, the handle would be separate or independent from the cleaning portion, a shorter handle coupler may be provided, and the accordion hose would feature a grip end on both ends, replacing the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 2A is an isometric view of the vacuum dusting attachment device illustrating the flat cleaning portion open chambers and including partial cutaway views of the vents in the neck area, the inside of the perimeter tube facing outwards, and the inside ridges of the flat cleaning portion and the handle portion which facilitate a swiveling action.

FIG. 2B illustrates an alternate arrangement for providing a light assembly for use with the dusting attachment of the present invention.

DETAILED DESCRIPTION OF THE INVENTION

The following detailed description is of the best mode or modes of the invention presently contemplated. Such description is merely exemplary in nature and is not intended to be understood in a limiting sense, but to be an example of the invention presented solely for illustration thereof, and by reference to which in connection with the following description and the accompanying drawings one skilled in the art may be advised of the advantages and construction of the invention.

Figure 7A:
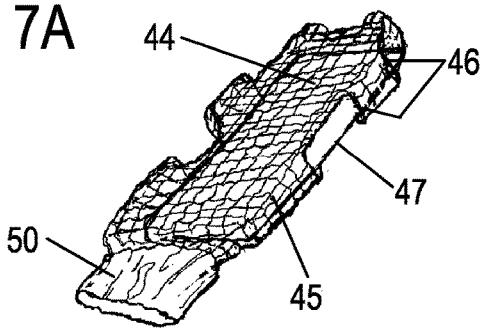
FIG. 7A is an isometric view of an embodiment of the microfiber mesh sock-like slip on cover that fits over the flat cleaning portion of the vacuum dusting attachment device.
Figure 7B:
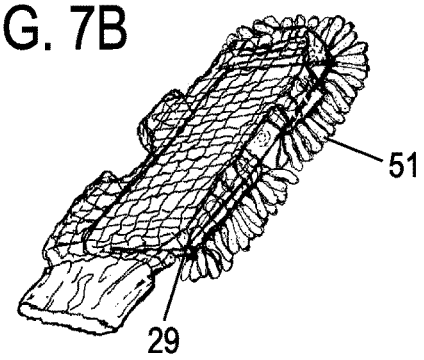
FIG. 7B is an isometric view of another embodiment of the mesh cover having microfiber noodle-like projections on one side.
Figure 8A:
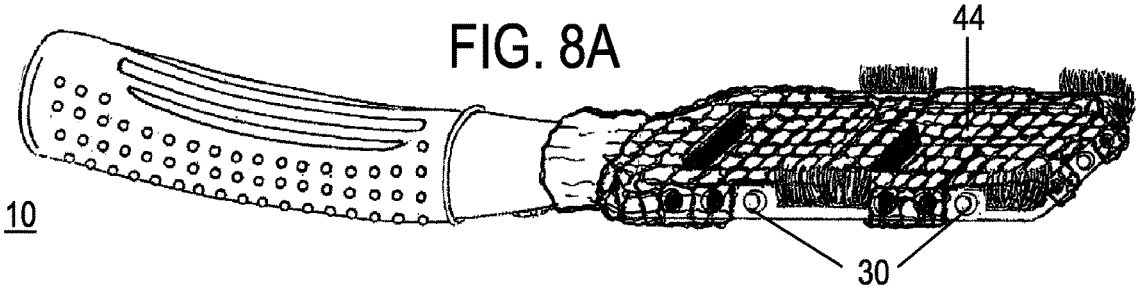
FIG. 8A is a first side view of the microfiber mesh sock-like slip on cover on the flat cleaning portion of the vacuum dusting attachment device.

FIGS. 1-10 illustrate several embodiments of a vacuum cleaner dusting attachment device 10 and an optional use accordion-style hose vacuum attachment device 11 in accordance with the present disclosure. As shown in FIGS. 1-6 and 8, vacuum cleaner dusting attachment device 10 is generally comprised of a flat cleaning portion 12 and a swivel connected handle portion 16. FIGS. 10A-B illustrate another embodiment of device 10 having a detachable or independent handle portion 17. In other embodiments, the vacuum cleaner dusting attachment device 10 may be of a unitary construction. Also shown in FIGS. 1 and 7-8 is a slip-on cover 14 which is configured to be secured over flat cleaning portion 12 of device 10, and is preferably made of a microfiber mesh material. Cover 14 is designed for use with any of the embodiments of vacuum cleaner dusting attachment device 10.

Figure 1A:
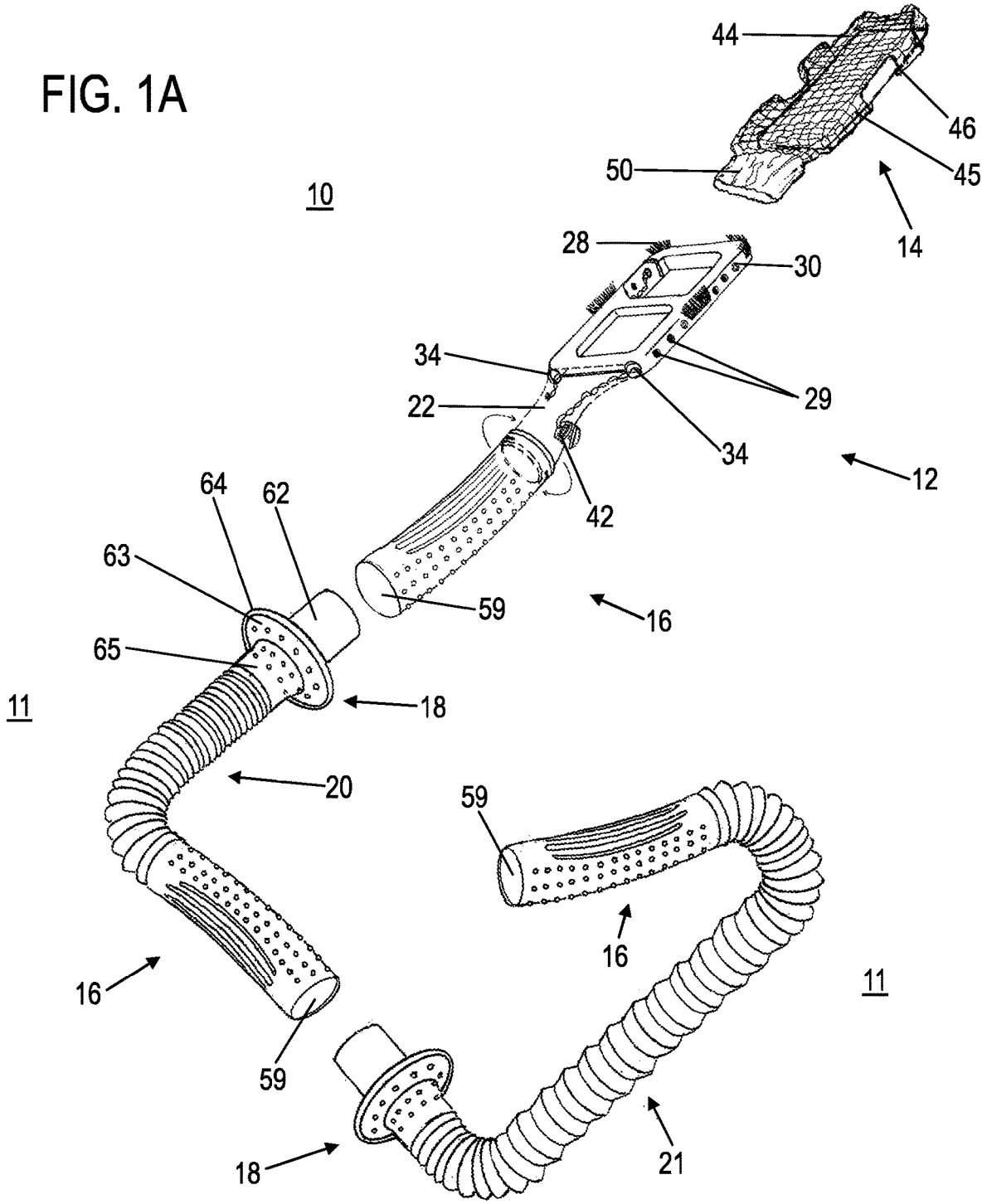
FIG. 1A is an isometric view of the multi-chamber vacuum dusting attachment and optional use accordion hose vacuum attachment of the invention.
Figure 1B:
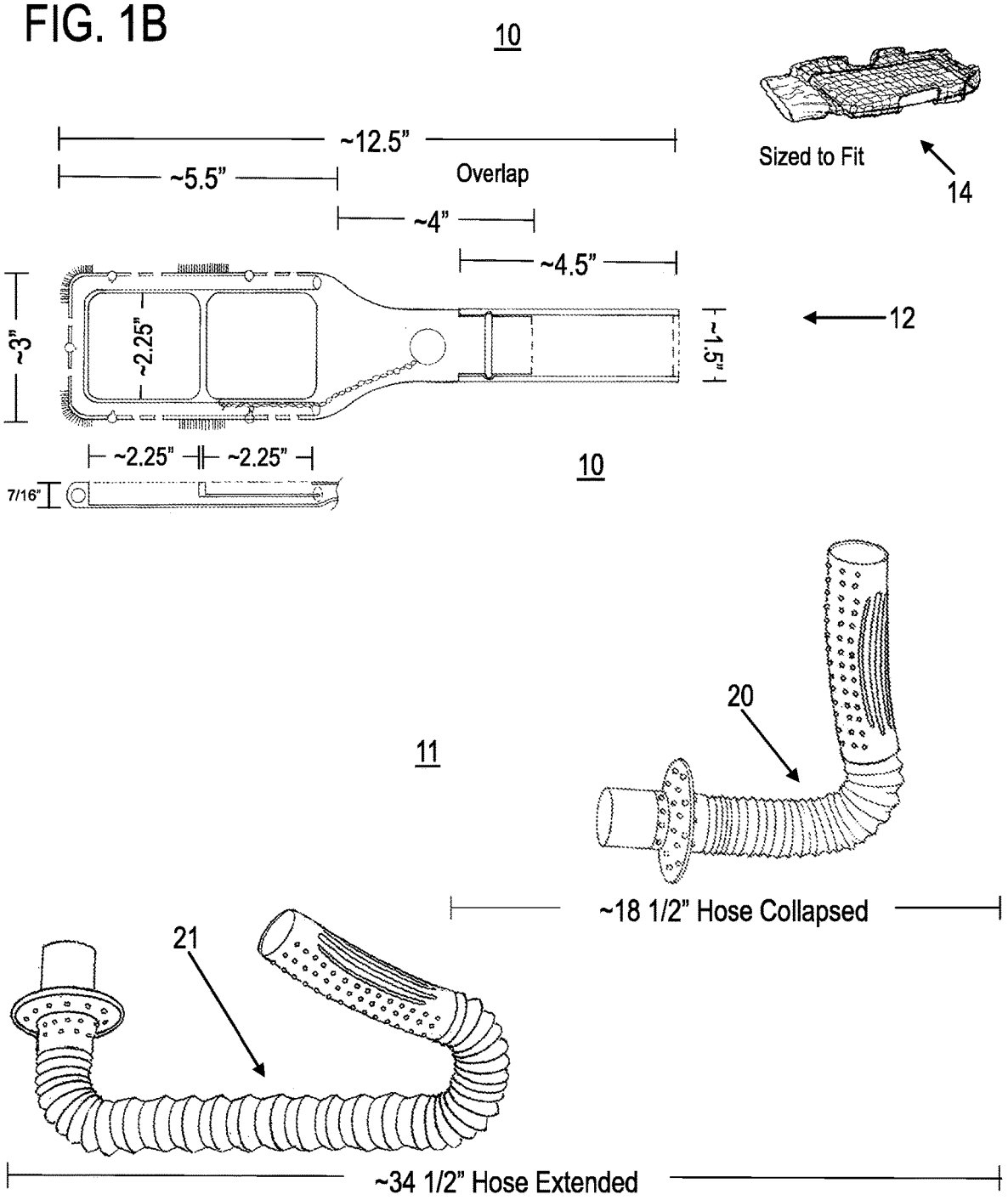
FIG. 1B illustrates the approximate line measurements of an embodiment of the vacuum dusting attachment and optional use accordion hose vacuum attachment when the hose portion is fully collapsed and fully expanded.
Figure 9:
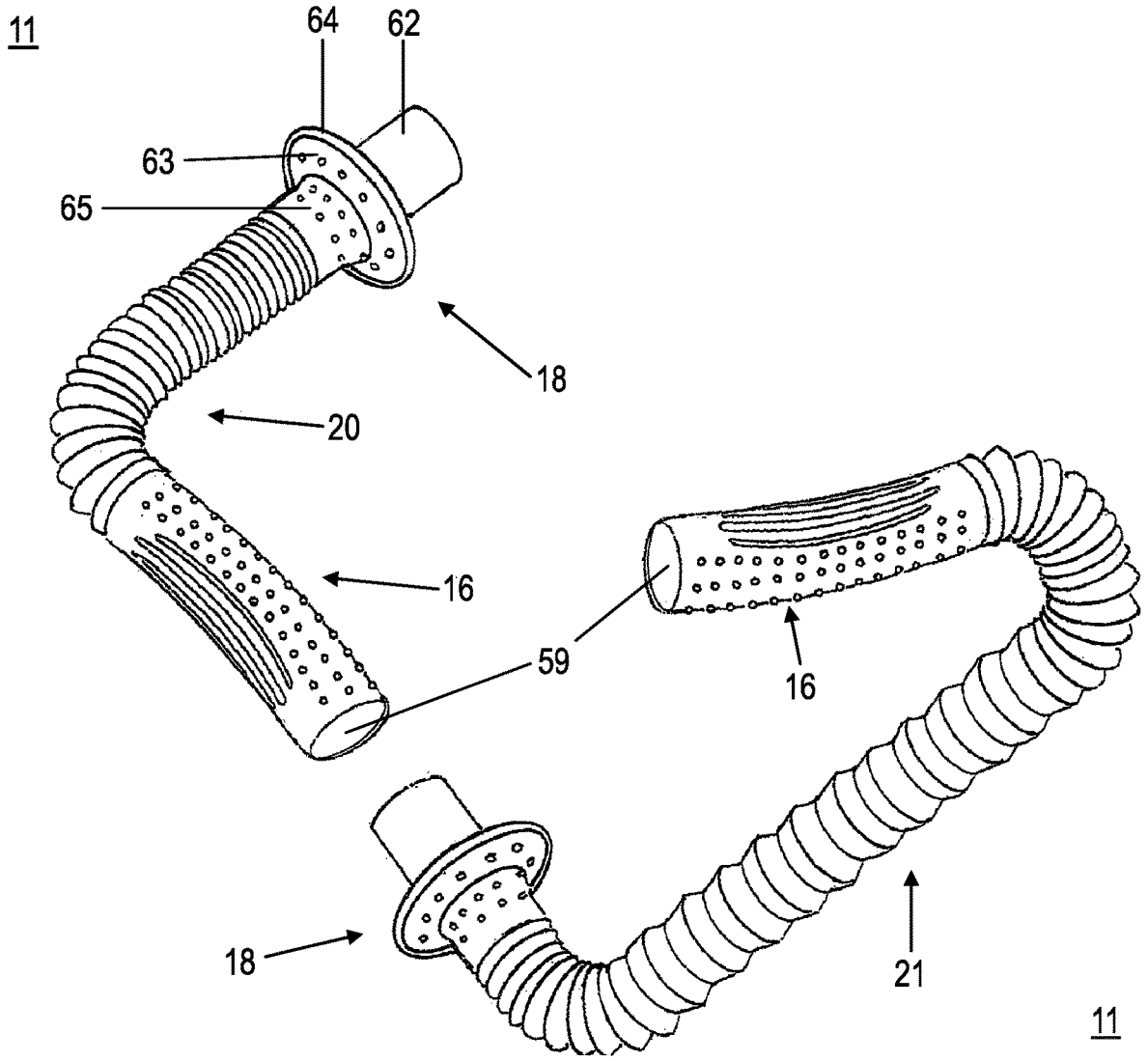
FIG. 9 illustrates the optional use accordion hose vacuum attachment of the invention in which in a first accordion hose is shown partially collapsed and a second accordion hose is shown partially expanded.
Figure 10A:
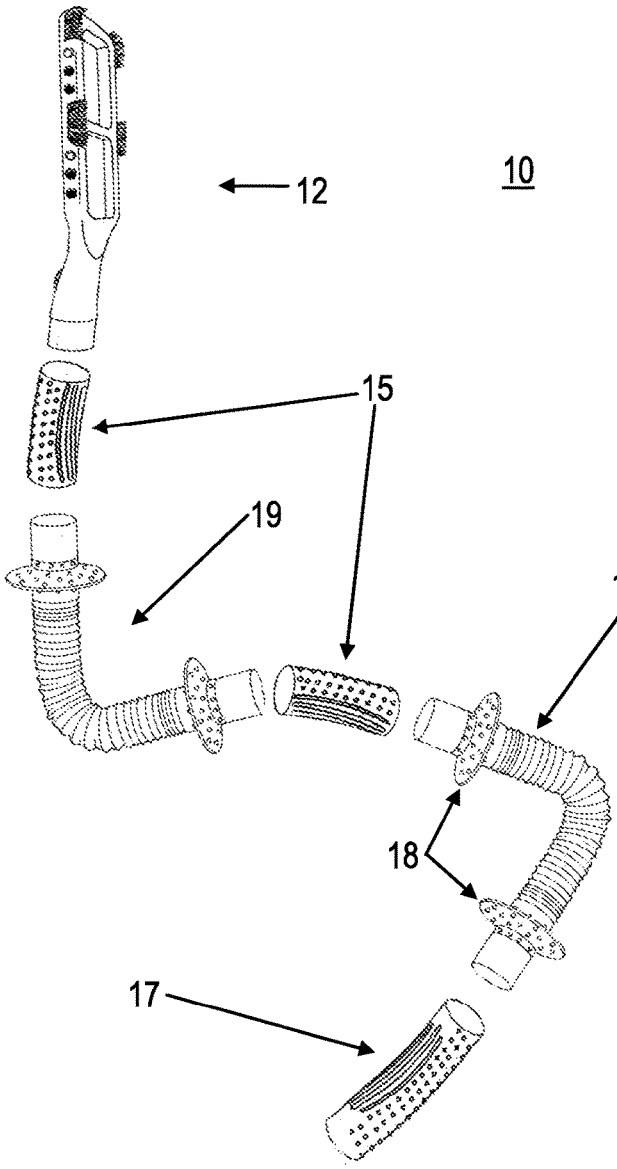
FIG. 10A illustrates a first alternative arrangement for connecting the vacuum dusting attachment and accordion hose in which the vacuum dusting handle portion is independent from the cleaning portion, grip disks are attached to both ends of the accordion hose, and handle couplers of different lengths are employed.
Figure 10B:
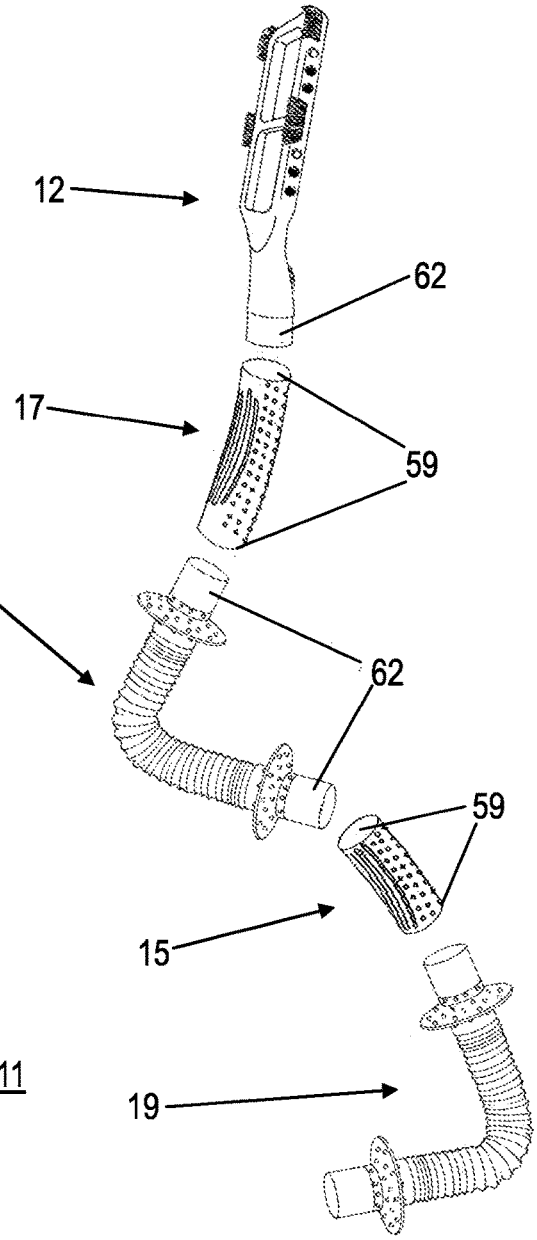
FIG. 10B illustrates a second alternative arrangement for connecting the vacuum dusting attachment and accordion hose.

Flat cleaning portion 12 of device 10 is preferably made in one piece such as by an injection molding process using materials such as, but not limited to, soft Thermal Plastic Rubber (TPR), hard silicone, or of other suitable and similar type materials. Flat cleaning portion 12 may be slightly flexible but must be sufficiently rigid so as not to collapse the vacuum chambers during use. An additional supportive material may be placed internally at strategic locations to prevent collapsing up to a stress hold limitation. Accordion-style hose vacuum attachment device 11, as represented in FIGS. 1A-B and 9, generally includes a handle portion 16, a disk grip 18, and an accordion hose portion 20, 21 configured to be joined between the handle portion 16 and disk grip 18. Two separate accordion-style hose vacuum attachment devices 11 are shown being used together in FIGS. 1A-B, wherein accordion hose 20 in one device 11 is shown in a mostly collapsed position, and accordion hose portion 21 in the other device 11 is shown mostly in an extended position. FIG. 10 illustrates an alternate arrangement where disk grips 18 are provided on both ends of accordion hose 19, and the devices 11 are connected in an end-to-end or stacked relationship either by couplers 15 or independent handle couplers 17. The stacking of device 11 illustrates the ability to connect additional devices 11 as needed to increase the overall length of distance of reach that can be obtained by using device 11 so that device 10 can be used to collect dust from unusually far or distant and hard to reach areas which need dusting.

Figure 3:
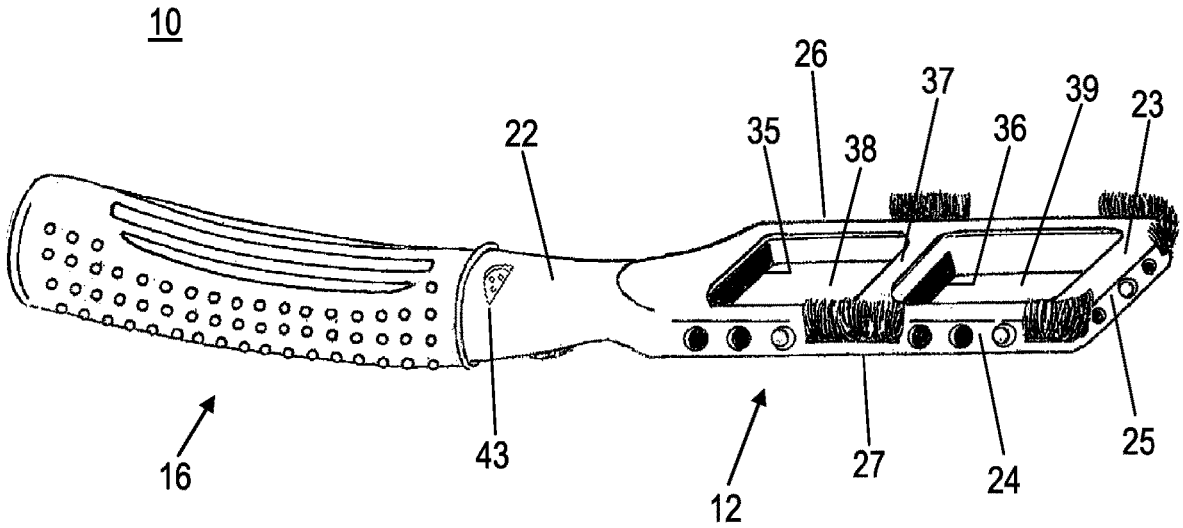
FIG. 3 is a side view of the vacuum dusting attachment device that illustrates the opposite directional view of the open vents on the flat cleaning portion open vents and a possible pin port location on the device.
Figure 4:
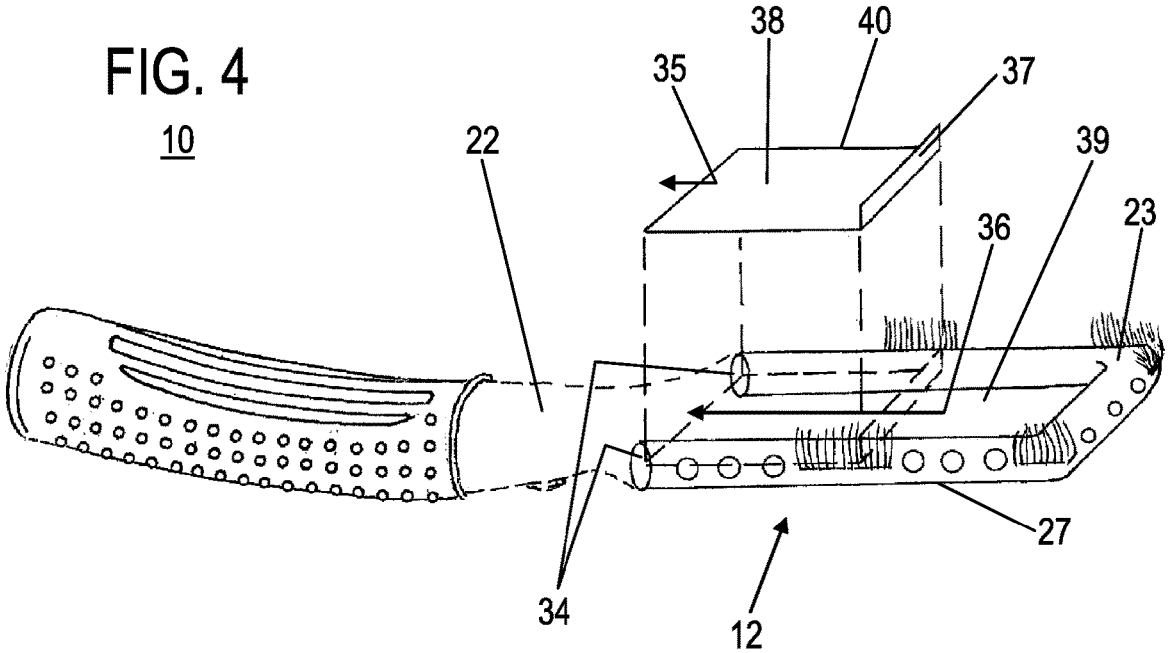
FIG. 4 is a partially exploded side view of the flat cleaning portion illustrating the horizontal panel for equalizing the vacuum suction.
Figure 5:
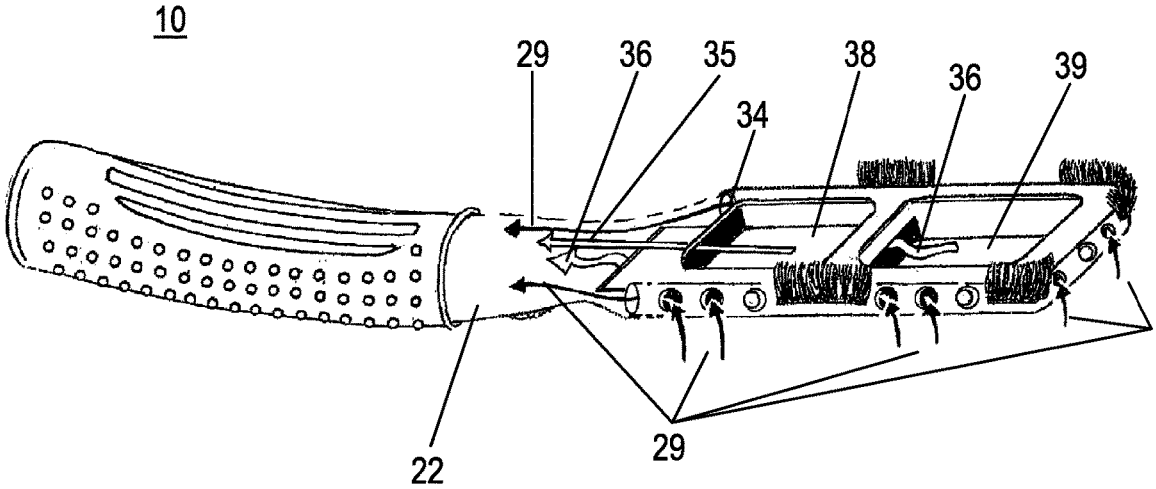
FIG. 5 is another side view illustrating the directional flow of the intake vents of vacuum dusting attachment device.
Figure 6:
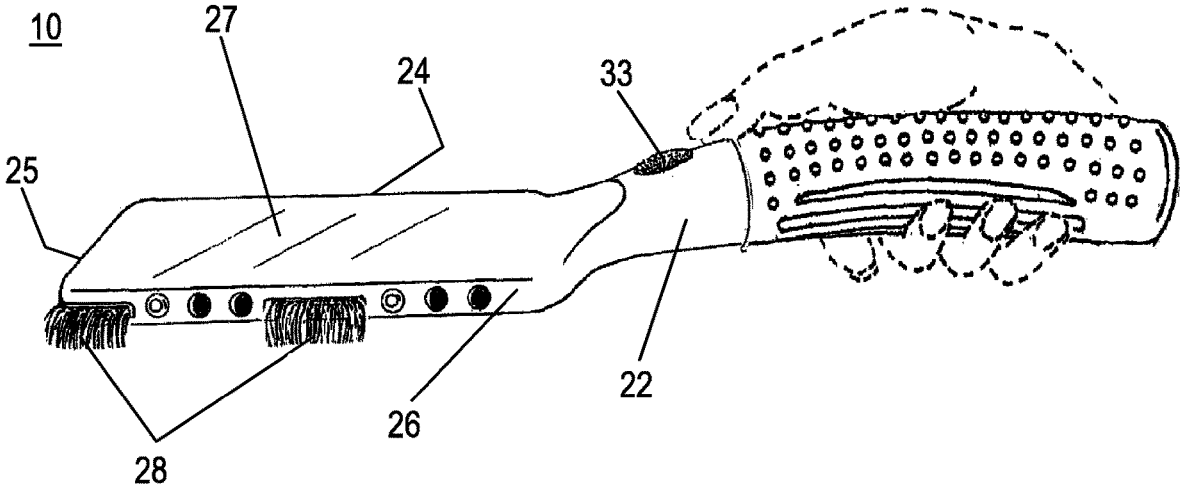
FIG. 6 is an opposite side view of the solid side of the flat cleaning portion also showing the upward slope of the ergonomic handle portion.

Referring now in particular to FIG. 3, flat cleaning portion 12 of device 10 has a neck portion 22 and a generally flat rectangular shaped dust collecting housing or body defined by an inner end which connects to the neck portion 22, top wall 23, bottom wall 27, opposite side walls 24 and 26, and an outer end wall 25, which walls may have rounded or chamfered edges. A pair of longitudinally aligned open upper and lower, or proximal and distal, vacuum chamber vents 38 and 39 are formed in top wall 23 of flat cleaning portion 12, and are separated by a lateral center partition 37. Vacuum chamber vents 38 and 39 are preferably rectangular or square, although they may have other shapes, and comprise a major portion of the surface area of top 23. In addition, as illustrated in FIG. 4, a horizontal vane or panel 40 is situated extending horizontally in lower chamber vent 38 and connecting between side walls 24 and 26. Panel 40 is spaced inwardly from the open top of vent 38 and from the bottom wall 27, and forms the bottom wall or floor of vent 38. More particularly, horizontal panel 40 is spaced apart approximately equally from the open top of lower chamber vent 38 and the inwardly facing surface of bottom wall 27, and as shown in FIG. 5 one end of panel 40 may extend partially into hollow neck area 22 of device 12 while the other end terminates at center partition 37 (FIGS. 3 and 4) between the vacuum chambers 38 and 39. As shown in FIG. 4, in an embodiment horizontal panel 40 has a perpendicular lip which extends outwardly and forms at least a portion of center partition 37. As shown in FIG. 3, a smaller air flow vent 35 is located in the inner end of the chamber 38, and connects the vacuum chamber 38 with hollow neck area 22 of device 10. Similarly, air flow vent 36 is provided in an inner side wall of vacuum chamber 39 under center partition 37 and extends underneath panel 40 and between side walls 24 and 26 and the inner surface of wall 27 and opens to hollow neck area 22. Upper and lower vacuum chambers 38 and 39 are therefore defined and further enclosed by side walls 25, 26, and 27 around the perimeter. Because the chambers 38 and 39 are separated and have separate air flow or suction vents 35 and 36, respectively, the vacuum suction in vents 35 and 36 and as a result in chambers 38 and 39 is substantially equalized between the two chambers, thus allowing the flat cleaning portion 12 to be of a longer length than most dusting attachments that are available on the market today, and as such allowing more open aperture area for dust collection. The vacuum suction flow of the chambers is shown by arrows 29, 35, and 36 in FIG. 5.

In addition, as best illustrated in FIGS. 3 and 4, a chamber 34 is provided in flat cleaning portion 12 extending around the outer periphery of vacuum chambers 38 and 39 in the space defined by side walls 24 and 26, end wall 25, top and bottom walls 23 and 27, and the interior side walls of vacuum chambers 38 and 39. The perimeter tubular hollow open chamber 34 thus encircles the three edges of the tool portion 12 of device 10, and has open ends on both sides of the flat cleaning portion 12, where starting at the hollow neck area 22 (see FIG. 4), at the point that the flat cleaning portion tool flattens out, it continues along the side wall 24, (see FIGS. 3 and 6), swinging around the front of the flat cleaning portion edge 25, and it continues on along the opposite side wall 26, and ending again at the other side of the hollow neck area 22. The tubular hollow perimeter chamber 34 is solid along the inside area that faces the two vacuum chambers 38 and 39 and therefore is not connected to such chambers. As will be evident from viewing FIG. 2, a plurality of dust collecting holes 29 as well as openings which contain light elements 30 are located along the outside surface of the tubular perimeter chamber 34. The light elements 30 may be LED lights or another known type of light element, and can be solar powered, or powered by other methods described herein, but for these illustrated purposes the lights are connected to a battery source 42 and as shown in FIGS. 1 and 2. FIG. 2A includes a partial cutaway view of the side wall of chamber 39 which is cut away to illustrate an inside view of a section of the inner perimeter wall of chamber 34, such that a back view of one of the open holes 29 and of a light element 30 which is affixed to a string of wiring 31 is illustrated. Wiring string 31 is electrically connected to appropriate contacts in battery holding chamber 32, which in a preferred embodiment would use button or flat batteries 42 for space saving purposes, and the wiring string 31 would encircle inside the hollow perimeter chamber 34 and end and be attached to the inside wall of the neck 22, just beyond the other end opening of 34. Along the way, light elements 30 attached to the wiring string at designated locations would be placed in the allotted hole openings. Located at the top of the battery holding chamber 32 is a hinged lid member with an attached soft button on and off switch 33 which connects to the battery powering system (FIG. 2A). In an embodiment wiring 31 may be enclosed in an outer casing in order to minimize the amount of dust which collects on the wiring during use of the dust collection device 10 of the invention. Additionally, in an embodiment illustrated in FIG. 2B, outer edge tubular vent 34 may be provided as a separate structure from flat cleaning portion 12, if necessary, to input a wiring section, with the possibility of sliding on and off of flat cleaning portion 12.

Referring now in particular to FIGS. 1-6 and 8, sections of soft paint brush-like bristle clusters 28 are affixed to the outer perimeter of chamber 34. The bristles are configured so as to face upwards towards and extend slightly beyond the top surface 23 of flat cleaning portion 12 so as to facilitate the loosening and collection of dust and help direct the dust particles towards the open aperture vents 29, 35, and 36, of which by provision of a suction force and as shown by arrows 29, 35, and 36 in FIG. 5 the collected dust flows from the cleaning portion 12 to the neck area 22 and continues onto and into a vacuum receptacle.

Referring again to FIG. 2A, the hollow neck area 22 of flat cleaning portion 12 rounds out to fit into the hollow handle area 16 of device 10. At the very end of the rounded neck area 22 that is part of flat cleaning portion 12, a ridge 41 is formed on the outer surface of the rounded neck area which extends around and outwards and which when placed within hollow handle area 16, is received in an internal protruding ridge 54 of handle 16 keeping the two pieces connected as well as allowing flat cleaning portion 12 and handle portion 16 to swivel in a circular motion, which will allow for a greater fluidity of movement in the use of device 10.

The area 55 of the handle 16 of device 10 is specifically designed to be ergonomically shaped for comfortable gripping and use as it is held by a consumer. Further, the outer surface of handle area 55 is coated with soft material such as but not limited to TPR as well as having ridges 56 and/or raised bumps 57 (FIG. 2A) so as to allow for additional hand purchase especially if the hand sweats. The overall weight of the handle 16 is further lessened by using the interior area 59 for coupling with another device, since a main purpose of devices 10 and 11 is to provide lightweight tool attachments for use with a vacuum that are ergonomically comfortable.

Figure 8B:
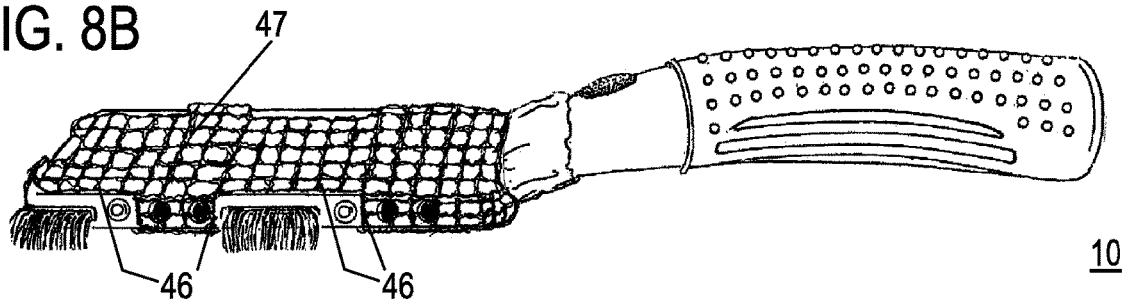
FIG. 8B is an opposite side view of the microfiber mesh sock-like slip on cover on the flat cleaning portion of the vacuum dusting attachment device.
Figure 8C:
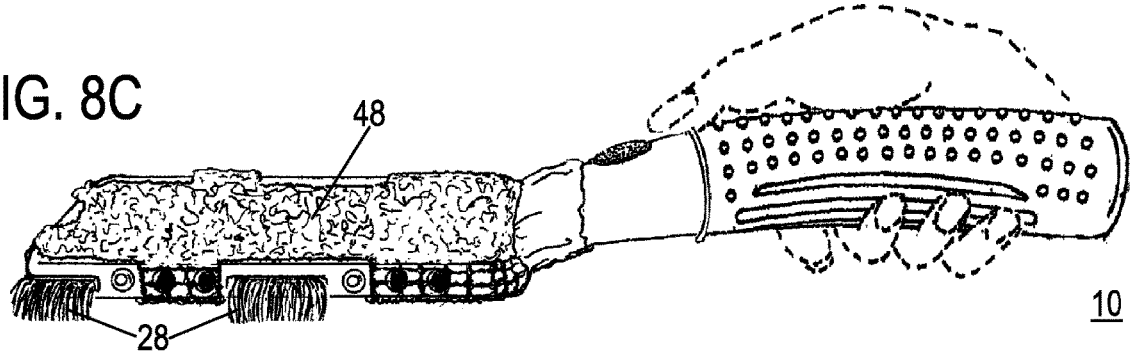
FIG. 8C is an opposite view of an alternative microfiber mesh sock-like slip on cover in which the microfiber mesh on the solid side flat of the cleaning portion of the vacuum dusting attachment device is replaced with a solid piece of microfiber fabric.

FIGS. 1 and 7-8 illustrate the microfiber mesh sock-like slip on cover 14 of the invention. Cover 14 is considered an integral part of flat cleaning portion 12 of the vacuum dusting attachment device 10. The flat cleaning portion 12 vacuum suction vents are not designed for use without using the microfiber cover as the outgoing flow direction vent 35 (FIGS. 3-5) that originates from upper vacuum chamber 38, and outgoing flow vent 36 that originates from the lower vacuum chamber 39, and the hollow tubular perimeter 34, are not designed for, and are too narrow to process anything larger than dust particles since any debris larger would be trapped in the narrow openings and block the vacuum suction flow. The microfiber mesh cover 14 (FIG. 7) thus protects the open apertures of the device. The open vents of device 10 are covered by the microfiber mesh top 44 and mesh sides 45, and sort debris size from entering. In addition to preventing large debris from entering the flat cleaning portion 12 of device 10, by the nature of microfiber, the microfiber mesh attracts and retains on the fibers additional dust and debris that does not enter the mesh holes. The microfiber holds onto the debris, even on the bottom area 47, 48 (FIGS. 8B, 8C) and retains it for further collection by the consumer by removing the vacuum dusting device 10 with the microfiber cover 14 still attached, and vacuuming off the dust and debris to clear the mesh openings with the open nozzle of a vacuum unit, or it could be shaken out, as well as washing or replacing it. Having additional mesh covers on hand could help in designating one for light soiled surfaces and another for unsanitary heavily soiled surfaces. A disposable cover could also be devised as well as color coordinated covers, and other covers could be devised in material for other purposes.

On the solid side 27 (see FIG. 6) of the flat cleaning portion 12 of device 10, the mesh cover 14 could alternately be made of a solid microfiber material 48 (FIG. 8C) which could be used for buffing, as well as protection from scratching surfaces. On the sides of the mesh cover there are sewn openings 46 (FIG. 8B) which allow for the brush bristles 28 (FIG. 8C) to come through as well as for the projected light from light elements 30 (FIG. 8A) to be unobstructed. The sock-like mesh cover 14 is held onto the flat cleaning portion 12 of device 10 by an elasticized soft cloth band 50 (FIG. 7) similar, but not limited to, to how a sock is held onto an ankle or calf. Another alternative is to create a microfiber mesh cover that attaches using a hook and loop system such as a Velcro® system whereby the microfiber cover attaches to a corresponding Velcro® strip placed onto the vacuum dusting attachment; and/or Velcro® is placed on corresponding ends of the microfiber cover that is manufactured as a flat piece so it wraps around and stays upon the vacuum dusting attachment. The Velcro® could be sewn onto the microfiber mesh cover 14 during production.

In an embodiment, as shown in FIG. 1B, the dusting attachment 10 has a length from the hose connection end handle 16 to end 25 of flat cleaning portion 12 of approximately 12½ inches. Handle 16 has a diameter of about 1½ inches at the hose connecting end, while neck area 22 of cleaning portion 12 has a length of about 4 inches. The flat dust collecting housing of cleaning portion 12 has a length of about 5½ inches and a width between the outer surfaces of side walls 24 and 26 of about 3 inches. Vacuum chambers 38 and 39 have dimensions of about 2.25 inches square, and thus cover a major portion of the surface area of the top surface 23 of the flat housing. This is made possible by the provision of separate suction vents 35 and 36 for the vacuum chambers 38 and 39, respectively, and vane 40 which as is also shown in FIG. 2B allows for separate substantially equalized suction forces to be directed to each chamber. Otherwise, the suction force in the lower chamber 39 would be much less than the upper chamber 38, since it is significantly further from the source of the vacuum suction, and the same would result if a single chamber was provided. It is preferred in embodiments including peripheral chamber 34 that the upper and lower chambers 38 and 39 comprise at least 50% of the surface area of top surface 23, and in a more preferred embodiment comprises at least 60% of the surface area of top surface 23. In the event that peripheral chamber 34 is omitted, chambers 38 and 39 can be enlarged even further although this is less preferred than having chamber 34. The dusting housing also has a height or thickness of about 7/16 inches, and thus is thin enough to fit in narrow spaces that need to be dusted, such as under a stereo receiver or the like as discussed above. In addition, the thin profile also contributes to the equalized suction force provided in the separate vacuum chambers 38 and 39 since although chamber 39 is somewhat deeper than chamber 38, the housing overall is sufficiently thin in use that there is little if any effect on the suction force. In addition, attachment 11 in the illustrated embodiment has a length of about 18½ inches when collapsed, and a length of about 34½ inches when expanded. The several components of the present invention may have different dimensions from the illustrated embodiment while still falling within the intended scope of the invention.

The accordion hose vacuum attachment device 11 (FIG. 9) is lightweight and can be expanded and collapsed to any desired length, or bent to any desired shape. Preferably the total expansion would be approximately 2 feet which would be a comfortable width for a consumer to manually pull out to expand or push to collapse the accordion hose which might tend to be of a sturdy material, using the disk grip 18 and the handle 16, which is structurally the same handle 16 used on device 10. Alternatively, as shown in FIG. 10, device 11 may be modified such that the handle side 16 is replaced with another disk grip 18 so as to insert additional length where a handle is not required, so the accordion hose would have disk grips on both ends. Each grip disk 18 is made of a sturdy material having a disc-shape which extends outwardly and is coated with a softer material similar to the handle 16, so that rim 64 is cushioned for comfort of the hand. The soft material on the disk continues as the disk diminishes to the rounded size area 63 and 65 that corresponds to the circumference of the accordion hose. A coupling insert nozzle end 62 is provided adjacent to the grip disk 18 for connecting adjacent hose sections end to end to expand the length of the hose. The accordion hose, shown in FIG. 9 and indicating as mentioned above the view 20 of the accordion hose partially collapsed and the view 21 of the accordion hose partially expanded, would be manufactured so the bellow walls are thick enough to resist collapsing from vacuum suction while extended and to retain any bended direction placed by the customer. A material for the hose shall have to be rigid, such as but not limited to a plastic material, but yet flexible so as to avoid cracking with repeated usage. The advantage of using the accordion hose is that it is lighter, bendable, and can telescope to any length desired within its range of maximum expansion for reaching specific target areas, and additional accordion hose vacuum attachments of device 11 can be coupled together to add more extension when needed, while always providing a conveniently located handle to grasp. Another advantage is that the hose may be collapsed to a length of approximately a third of the fully extended hose, making the accordion hose vacuum attachment 11 ideal for storage and carrying while cleaning as opposed to using rigid long extension hoses. Use of the grip disk 18 and handle 16 makes it easier to pull outwards to expand the length of the hose and push inwards to collapse the hose, while the handle can be used to hold and direct the accordion hose.

Referring again to the accordion hose vacuum attachment device 11 (FIG. 9), it should be noted that if attachment device 11 is attached directly behind the vacuum dusting attachment device 10, it can be raised to reach distant areas, but when close up cleaning is desired and the consumer is handling the vacuum dusting attachment 10, the accordion hose vacuum attachment 11 left attached to both the handle end and the vacuum cleaner can freely extend and swing unaided in any direction behind the consumer.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art, and, therefore, to effectively encompass the intended scope of the invention.

As used throughout, ranges are used as shorthand for describing each and every value that is within the range. Any value within the range can be selected as the terminus of the range. All references cited herein are hereby incorporated by referenced in their entireties. In the event of a conflict in a definition in the present disclosure and that of a cited reference, the present disclosure controls.

I claim:

1. A dusting attachment for a vacuum cleaner comprising:

a handle portion including an ergonomic hand grip, and a cleaning portion including a neck portion and a dust collecting housing, said handle portion connectible on one end to a suction hose for the vacuum cleaner and connected on another end to the neck portion, and an interior suction channel extending within the handle portion and neck portion in which a suction force may be generated by the vacuum cleaner, said dust collecting housing having an elongated flattened shape defined by a top wall, a bottom wall, opposite side walls and an outer end wall connecting between and defining a narrow width between the top and bottom walls, and an inner end connected to the neck portion, an upper chamber vent and a lower chamber vent each formed in the top wall of the dust collecting housing along the longitudinal axis of the housing, the upper chamber vent positioned between the inner end, opposite side walls and a partition extending laterally between the opposite side walls spaced from the end wall, and the lower chamber vent positioned adjacent the upper chamber vent between the outer end, opposite side walls, and lateral partition, and an upper chamber air flow channel connecting between the upper chamber vent and the suction channel in the neck portion, and a lower chamber air flow channel connecting separately between the lower vacuum chamber vent and the suction channel in the neck portion, wherein a substantially equalized suction force is provided in the upper and lower chamber vents, said upper and lower chamber vents comprising at least 60% of the top wall total surface area.

2. The vacuum cleaner dusting attachment of claim 1 additionally comprising another separate air flow channel formed in the dust collecting housing extending around the periphery of the upper and lower chamber vents and having ends which are open towards and in air communication with the suction channel in the neck portion, and a plurality of small spaced apart apertures extending between an outer surface of the housing and the peripherally located air flow channel.

3. The vacuum cleaner dusting attachment of claim 2 additionally comprising a slip-on cover securable over the flat dust collecting housing, said cover including a microfiber mesh portion positioned to extend over the upper and lower chamber vents and apertures in the peripheral air flow channel and having openings between the mesh large enough to allow dust to pass into the upper and lower chamber vents and peripheral air flow channel while preventing particles and objects larger than said openings from passing.

4. The vacuum cleaner dusting attachment of claim 1 additionally comprising a horizontal vane provided in the flat dust collecting housing connecting between the opposite side walls from the lateral partition towards the neck portion and spaced from the top and bottom walls.

5. The vacuum cleaner dusting attachment of claim 1 in which the handle portion is swivelably connected to the cleaning portion.

6. The vacuum cleaner dusting attachment of claim 1 in which the handle portion is detachably connected to the cleaning portion.

7. The vacuum cleaner dusting attachment of claim 1 in which the handle portion and cleaning portion are of a unitary construction.

8. The vacuum cleaner dusting attachment of claim 2 additionally comprising a plurality of light elements mounted on the dust collecting housing of the cleaning portion.

9. The vacuum cleaner dusting attachment of claim 8 in which light elements are mounted in apertures in one or more of the side and end walls of the dust collecting housing and are operably connected to a power source positioned in the neck portion.

10. The vacuum cleaner dusting attachment of claim 1 in which the hand grip is coated with a cushioning material including a plurality of ridges and raised bumps so as to provide an improved gripping surface.

11. The vacuum cleaner dusting attachment of claim 2 additionally comprising a plurality of bristle clusters affixed directly to the flat dust collecting housing around the perimeter of said housing.

12. The vacuum cleaner dusting attachment of claim 3 in which a surface of the slip-on cover positioned over the bottom wall of the dusting housing is made of a solid microfiber material.

13. The vacuum cleaner dusting attachment of claim 1 additionally comprising a vacuum hose attachment device which is securable to the handle portion of the dusting attachment, said vacuum hose attachment device including an accordion hose portion having bendable bellow-type walls which retain the hose portion in a selected expanded or collapsed length and angle, at least one outwardly projecting disk grip positioned adjacent an end of the accordion hose portion, and a coupling for connecting multiple hose portions end-to-end or to said handle portion.

14. The vacuum cleaner dusting attachment of claim 13 in which the vacuum hose attachment device additionally comprises an integral handle portion connected to the accordion hose portion on an end opposite the disk grip.

15. The vacuum cleaner dusting attachment of claim 13 in which a disk grip is provided on opposite sides of the accordion hose portion.

16. The vacuum cleaner dusting attachment of claim 6 additionally comprising an ergonomic hand grip coupler for alternatively connecting one or more modified vacuum hose attachment extension devices and modified neck portions directly to the modified neck portion of the dusting attachment.

17. A dusting attachment for a vacuum cleaner comprising:

a handle portion; and a cleaning portion, wherein, the handle portion comprises a vacuum cleaner hose connecting end, a cleaning portion connecting end, and an internal air flow passageway extending through the handle portion between the vacuum cleaner hose connecting end and cleaning portion connecting end; and wherein, the cleaning portion comprises a neck portion and a dust collecting housing, said neck portion connected on one end to the cleaning portion connecting end of the handle portion and on another end to the dust collecting housing, and an internal air flow passageway extending through the neck portion between the handle portion connecting end and dust collecting housing connecting end, said dust collecting housing having a distal end, a proximal end, and a flattened, elongated body, and including at least a first large suction vent aperture formed in a top wall of the dust collecting housing extending from the proximal end of the housing, and a second large suction vent aperture also formed in the top wall extending from the distal end of the housing, said first and second apertures comprising a major portion of the top wall, and separate air flow chambers connecting between the air flow passageway in the neck portion and the first and second vent apertures.

18. The dusting attachment of claim 17 in which the dust collecting housing additionally comprises a peripheral suction chamber extending around the first and second vents, said peripheral suction chamber including a plurality of spaced apart small vent openings connecting to an outer surface of the dust collecting housing.

19. The dusting attachment of claim 18 in which the flattened dust collecting housing has a length of about 5.5 inches, a width of about 3 inches, and a thickness of about 7/16 inches, and the first and second vent apertures have a length and width of about 2.25 inches.

20. The dusting attachment of claim 17 additionally comprising a microfiber sock-like mesh cover which is securable over the flat dust collecting housing with a microfiber mesh portion positioned over the first and second vents to prevent large debris from entering the vents, said microfiber attracting and retaining at least some of said debris for subsequent disposal.

* * * * *